United States Patent [19]

Tokuyama et al.

[11] 3,996,439

[45] Dec. 7, 1976

[54] PUFFER-TYPE GAS-BLAST CIRCUIT BREAKER

[75] Inventors: Shunji Tokuyama; Yoshio Yoshioka, both of Hitachi, Japan

[73] Assignee: Hitachi, Ltd., Japan

[22] Filed: Jan. 7, 1975

[21] Appl. No.: 539,080

[30] Foreign Application Priority Data

Jan. 16, 1974 Japan ..... 49-7098

[52] U.S. Cl. ..... 200/148 A; 200/150 G

[51] Int. Cl.[2] ..... H01H 33/82

[58] Field of Search ..... 200/150 G, 148 A

[56] References Cited

UNITED STATES PATENTS

| | | | |
|---|---|---|---|
| 3,679,851 | 7/1972 | Latour | 200/150 G |
| 3,739,125 | 6/1973 | Noeske | 200/148 A |

FOREIGN PATENTS OR APPLICATIONS

| | | | |
|---|---|---|---|
| 795,351 | 3/1936 | France | 200/150 G |
| 1,019,819 | 2/1966 | United Kingdom | 200/148 A |

*Primary Examiner*—Gerald P. Tolin

*Attorney, Agent, or Firm*—Craig & Antonelli

[57] ABSTRACT

A circuit breaker comprising an interrupting unit mounted in a vessel filled with a charge of arc extinguishing gas of uniform pressure and operating such that when the circuit is broken the arc extinguishing gas is compressed to increase its pressure, so that the high pressure gas will be blown against an electric arc established between the contacts to extinguish the same. The circuit breaker is formed therein with two paths for the high pressure gas blown against the arc, each path having an insulating nozzle mounted in it.

11 Claims, 7 Drawing Figures

PUFFER-TYPE GAS-BLAST CIRCUIT BREAKER

BACKGROUND OF THE INVENTION

1. Field of the Invention

This invention relates to circuit breakers, and more particularly it is concerned with a puffer type gas circuit breaker formed therein with two paths for blowing gas therethrough.

2. Description of the Prior Art

Puffer type gas circuit breakers of simple construction are known as circuit breakers of high capacity.

A puffer type gas circuit breaker comprises an interrupting unit mounted in an enclosure filled with a charge of arc extinguishing gas (e.g. SF6 gas) of uniform pressure. The interrupting unit includes a puffer chamber composed of a piston and a cylinder either of which is driven to compress the arc extinguishing gas in the puffer chamber. The piston or cylinder which is driven is connected to a movable contact, so that the contacts are brought out of engagement with each other as the arc extinguishing gas in the puffer chamber is compressed. The arc extinguishing gas compressed in the puffer chamber is led through an insulating nozzle and blown against the electric arc to extinguish the same.

The insulating nozzle is an important factor concerned in determining the current interrupting performance of circuit breakers of this type. Thus various improvements have been made in or relating to the insulating nozzle so as to greatly increase the current interrupting capabilities of the breakers.

Proposals have been made to use a double flow structure in which two streams of gas are formed instead of a single flow structure in which a single stream of gas is formed and directed from the puffer chamber to the outside through the throat of a single insulating nozzle, in order that the current interrupting capability may be greatly increased.

The double flow structure of the prior art represents a conversion of the single flow structure into the double flow structure in which the characteristics of the single flow structure are still retained. Thus no structure best suiting the double flow of gas has ever been produced. Moreover, one of the paths of flow of gas according to the prior art is formed by a metallic nozzle constituting a hollow contact. Because of this arrangement, it has hitherto been impossible for the nozzles to perform an arc extinguishing action satisfactorily.

SUMMARY OF THE INVENTION

An object of the invention is to provide a circuit breaker whose current interrupting performance is greatly improved in spite of the fact that the circuit breaker is simple in construction.

Another object of the invention is to provide a circuit breaker in which an electric arc established when the current is interrupted exerts no influences on the pressure rise characteristics of the gas in the puffer chamber.

Another object of the invention is to provide a circuit breaker in which arcing time is reduced.

The outstanding characteristic of the invention is that two openings are formed in the puffer chamber defined by a piston and a cylinder and aligned with each other to maintain the interior of the puffer chamber in communication with the outside therethrough, with each opening being provided with an insulating nozzle. An electric arc established when the current is interrupted is exposed to an extinguishing gas which flows through the two insulating nozzles and is blown against the arc. Each of the insulating nozzles can be made to have a form which best suits the condition and serves the purpose of use without taking the other nozzle into consideration. This is a technical advance over the prior art in which the form of the insulating nozzle has to be decided by taking the other or metallic nozzle into consideration, and which can provide improvements in current interrupting performance. The insulating nozzles are made of a diphenyl ether resin or polytetrafluoroethylene resin which itself emits an arc extinguishing gas when exposed to a large amount of heat produced by an arc when the current is interrupted. The gas produced in this way is added to the arc extinguishing gas discharged from the puffer chamber, thereby greatly increasing the efficiency with which the current is interrupted.

Other and additional objects and features of the invention will become evident from the description set forth hereinafter when considered in conjunction with the accompanying drawings.

DESCRIPTION OF THE PREFERRED EMBODIMENTS

Figure 2:
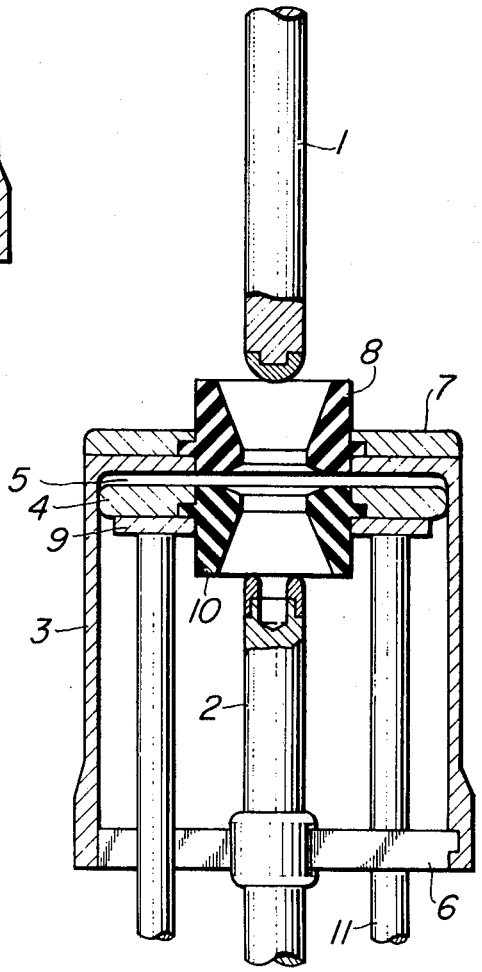

Preferred embodiments of the invention will now be described with reference to the accompanying drawings. The interrupting unit, which is shown in FIG. 2 in a circuit breaking position, is mounted in a vessel (not shown) which is filled with a charge of arc extinguishing gas (e.g. SF6 gas) of uniform pressure. A fixed contact 1 which is electrically connected to one terminal and a movable contact 2 which is electrically connected to another terminal are arranged coaxially in juxtaposed relation. The latter is connected to an operating device with an insulating operating rod (not shown).

Figure 1:
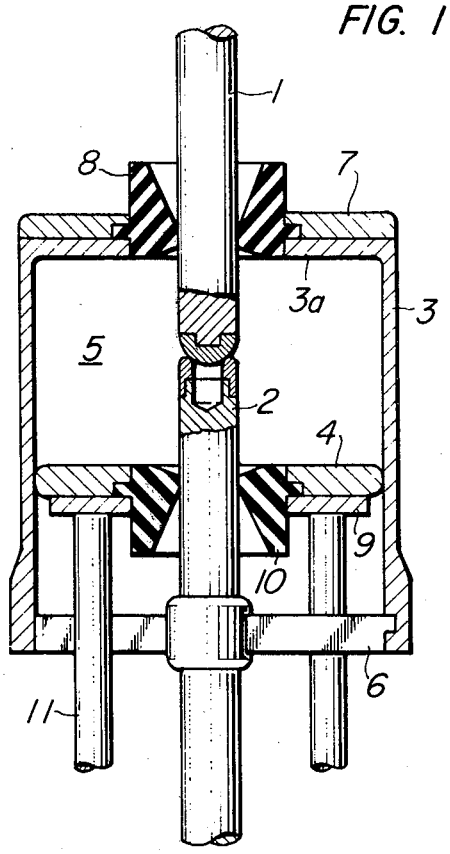
FIG. 1 and FIG. 2 are vertical sectional views of the interrupting unit of the circuit breaker comprising one embodiment of the invention, FIG. 1 showing the interrupting unit in a circuit making position and FIG. 2 showing the same in a circuit breaking position.

In FIG. 1, a cylinder 3 is arranged to enclose the two contacts 1 and 2 substantially concentrically and includes an end plate 3a in which the first insulating nozzle 8 is mounted. In the illustrated embodiment, the first insulating nozzle 8 is formed with a flange which is held between the end plate **3*a* and a disk 7. It is to be understood, however, that the first insulating nozzle 8 may be fixed to the end plate 3*a* by bolts. The disk 7 is fixed to the end plate 3*a*** by bolts.

Arranged in the cylinder 3 is a piston 4 which cooperates with the cylinder 3 to define a puffer chamber 5. The piston 4 is formed therein with an opening in which the second insulating nozzle 10 is mounted. In the illustrated embodiment, the second insulating nozzle 10 is formed with a flange which is held between the piston 4 and a disk 9. The piston 4 and the second insulating nozzle 10 are supported by posts 11 connected to an immovable member (not shown).

The cylinder 3 is connected to the movable contact 2 through a bar 6 which is disposed outside the puffer chamber 5. Thus, if the movable contact 2 is operated and released from engagement with the fixed contact 1 to break the circuit, the puffer chamber 5 will have its volume reduced and the arc extingushing gas will have its pressure increased. The insulating nozzles 8 and 10 through which the interior of the puffer chamber 5 is maintained in communication with the outside have their respective throats closed by the contacts. Thus, the pressure of the arc extinguishing gas in the puffer chamber 5 is increased till the contacts are withdrawn from the respective throats of the nozzles.

The fixed contact 1 and movable contact 2 may constitute a main path of current. Alternatively, a main fixed contact electrically maintained in sliding engagement with the cylinder 3 may be provided in shunt with the fixed contact 1, while a current collector electrically maintained in sliding engagement with the cylinder 3 may be provided on outer periphery of the latter and electrically connected to the movable contact 2. If this is the case, the two contacts 1 and 2 will be used as are producing contacts.

The circuit breaking operation will now be described. Upon instructions being given for breaking the circuit, the circuit breaker operating device (not shown) is rendered operative. This moves the movable contact 2 downwardly with the insulating operating rod, with a result that the movable contact 2 is brought out of engagement with the fixed contact 1. However, as is well known, either the fixed contact 1 or the movable contact 2 has a wipe construction, so that their disengagement will be delayed. Accordingly, compression of the arc extinguishing gas in the puffer chamber 5 is effected before the disengagement of the two contacts takes place, and the two contacts are brought out of engagement with each other when the pressure of the arc extinguishing gas reaches a predetermined level, thereby producing an electric arc between the contacts.

Upon actuation of the movable contact 2 and cylinder 3, the fixed contact 1 is withdrawn from the first insulating nozzle 8 and the movable contact 2 is withdrawn from the second insulating nozzle 10 as shown in FIG. 2. As a result, the arc extinguishing gas compressed in the puffer chamber 5 is formed into streams of gas which move from the chamber 5 to the outside through the two insulating nozzles 8 and 10. These two streams of gas are blown against the arc to extinguish the same. Withdrawing of the contacts 1 and 2 from the insulating nozzles 8 and 10 respectively may be synchronized or withdrawing of one contact may lag behind withdrawing of the other contact.

As aforementioned, in puffer type gas circuit breakers, current interrupting performance has been greatly improved by the provision of an improved insulating nozzle through which the compressed arc extinguishing gas can be directed against the arc. In this embodiment, two insulating nozzles are used to provide a double flow structure. This is conductive to a further improvement in current interrupting performance. It has been found that, when a diphenyl ether resin (marketed under the trade name "Delrin" by the American du Pont Company) or a polytetrafluoroethylene (marketed under the trade name "Teflon" by the same company) is used to make the insulating nozzles, an electric arc produced when the circuit is broken causes an arc extinguishing gas (e.g. HF4) to be released from the insulating nozzles themselves and added to the arc extinguishing gas which is blown from the puffer chamber 5 against the arc.

The gas released from the insulating nozzles is considered to increase the arc extinguishing capability of the interrupting unit and greatly contribute to the provision of an improvement in current interrupting performance. That is, the insulating nozzles not only serve as guides for streams of gas blown against the arc but also have an arc extinguishing capability. It will be noted that the use of the hollow portion of the movable contact as a path of movement of the gas stream in the prior art has not brought about an improvement in current interrupting performance, even if a suitable form can be selected for guiding the flow of the gas stream.

In the embodiment shown and described, the insulating nozzles are supported in such manner that the inside of the insulating nozzles 8 and 10 directly communicates with the interior of the puffer chamber 5. By virtue of this arrangement, the current interrupting performance of the circuit breaker can be improved owing to an increase in the pressure rise characteristic of the puffer chamber 5. In the prior art, the inside of the insulating nozzle is maintained in communication with the interior of the puffer chamber 5 through a small aperture formed in the cylinder 3. Because of this arrangement, no compression of the gas takes place inside the insulating nozzle, although the gas in the puffer chamber 5 is effectively compressed. Thus, the provision of the insulating nozzle in the prior art has deleterious effect on the pressure characteristics of the puffer chamber 5 and has reduced the current interrupting capability of the circuit breaker.

In the embodiment shown in FIG. 1 and FIG. 2, the cylinder 3 is movable while the piston 4 is fixed. It is to be understood that the present invention can have application in interrupting units in which the piston 4 is movable and the cylinder 3 is fixed. The insulating nozzles 8 and 10 need not necessarily be mounted on the cylinder and piston respectively and may be fixed to any other suitable members so long as it is through the two insulating nozzles 8 and 10 arranged independent of each other that the interior of the puffer chamber 5 is maintained in communication with the outside.

From the foregoing description, it will be appreciated that according to the present invention the paths for the streams of gas flowing from the interior of the puffer chamber 5 to ambient gas and blown against the arc are formed independently of each other and that the two paths are each provided with an insulating nozzle. This enables the insulating nozzles themselves to contribute to the provision of an improvement in current interrupting performance. Also, each insulating nozzle can be constructed so as to have a most suitable form for the path of the stream of gas for which it is intended, thereby improving current interrupting performance. For example, by employing the double flow structure, it is possible to adopt a suitable form for each insulating nozzle without requiring to form the inner surfaces of the nozzles in such manner that they cooperate with each other to produce streams of gas flowing in two directions.

When the interrupting unit is constructed such that an electric arc is produced within the puffer chamber, this will give rise to a problem. The problem is that, as the voltage and capacity of circuit breakers become higher, a markedly high current will have to be interrupted, and the energy of the arc produced will cause an inordinate rise in pressure in the puffer chamber 5. Since the inordinate rise in pressure will produce a reaction in the operating device, it would appear that it has deleterious effect on the circuit breaking operation characteristics of the circuit breaker.

This problem can be obviated by floatingly supporting any one of the members defining the puffer chamber 5 or a space connected thereto by using a compression spring or other resilient means. By this arrangement, it is possible to move through the spring such floatingly supported member when an inordinately high pressure is created in the puffer chamber and reduce the pressure to keep it substantially constant by varying the volume of the puffer chamber 5.

Figure 3:
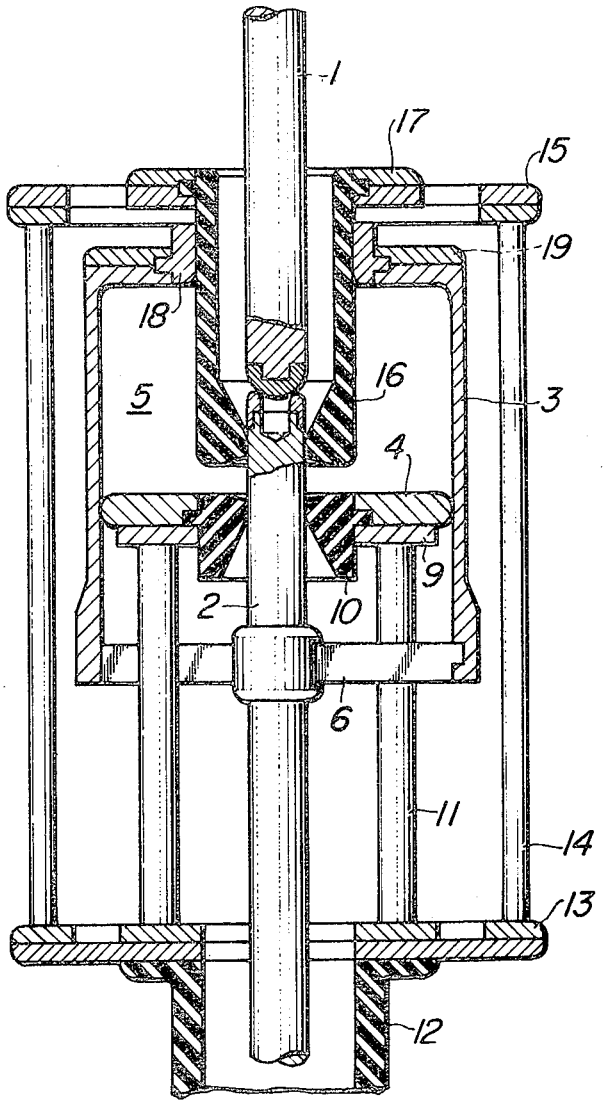
FIG. 3 and FIG. 4 are vertical sectional views of the interrupting unit of the circuit breaker comprising a second embodiment of the invention, FIG. 3 showing the interrupting unit in a circuit making position and FIG. 4 showing the same in a circuit breaking position.
Figure 4:
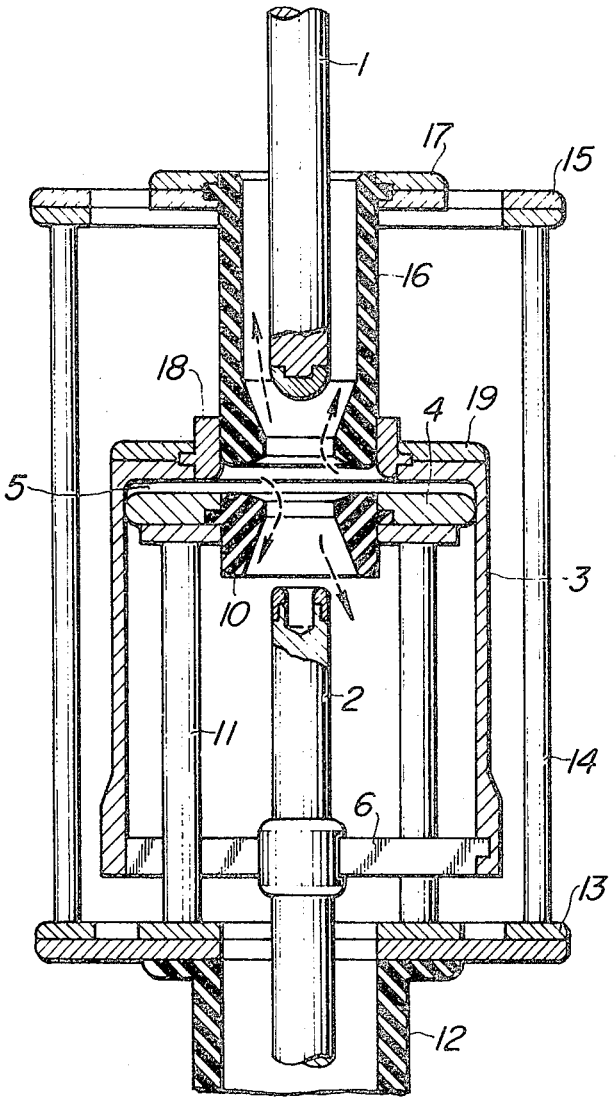

FIG. 3 and FIG. 4 show a second embodiment of the invention. Like reference characters designate similar parts in FIGS. 1 to 4. Affixed to a vessel filled with a charge of arc extinguishing gas of uniform pressure is an insulating cylinder 12 mounting therein a support plate 13 which supports another support plate 15 through support posts 14. Formed in the support plate 15 is an opening which is concentric with the fixed contact 1 and which has mounted therein the first insulating nozzle 16 opening in the puffer chamber 5 and held between the support plate 15 and a keep plate 17.

The cylinder 3 connected to the movable contact 2 has one open end thereof sealed by the piston 4 mounted in the cylinder 3 in sliding engagement with its inner wall surface and has affixed to the other open end thereof a sliding ring 18 which is capable of sliding along outer periphery of the first insulating nozzle 16. The interior of the puffer chamber 5 defined by the cylinder 3 and piston 4 is maintained in communication with the outside only through the first insulating nozzle 16 and the second insulating nozzle 10 mounted in the piston 4 when a current interrupting operation is performed.

The first and second insulating nozzles 16 and 10 are both affixed to the insulating cylinder 12, with the distance between the throats of the two insulating nozzles being constant at all times.

In FIG. 3 in which the interrupting unit is shown in a circuit making position, the movable contact 2 extends through the associated second insulating nozzle 10 into the throat of the first insulating nozzle 16 where it is maintained in engagement with the fixed contact 1. That is, the fixed contact 1 and the throat of the first insulating nozzle 16 associated therewith is spaced apart a predetermined distance, so that the two contacts are in contact with each other outside the puffer chamber 5.

A circuit breaking operation is performed by moving the movable contact 2 downwardly by means of an operating device (not shown).

Although not shown, a well-known wipe construction may be provided between the two contacts. If this is the case, the two contacts may be maintained in contact with each other within the puffer chamber 5 when the interrupting unit is in a circuit making position. However, the operation of bringing the two contacts out of engagement with each other is started from the position in which they are shown in FIG. 3.

Thus the disengagement of the movable contact 2 from the fixed contact 1 takes place outside the puffer chamber 5 and an electric arc is produced between them as soon as they are out of engagement with each other. At the same time, the sliding ring 18 affixed to the cylinder 3 moves in sliding motion along the outer periphery of the first insulating nozzle 16 to thereby compress the arc extinguishing gas in the puffer chamber 5. Simultaneously as the movable contact 2 is withdrawn from the throat of the first insulating nozzle 16, a stream of gas flowing from the puffer chamber 5 through the throat of the first insulating nozzle 16 and directed outwardly of the chamber 5 is formed and blown against the arc.

Further downward movement of the cylinder 3 causes the movable contact 2 to be withdrawn from the throat of the second insulating nozzle 10 as shown in FIG. 4. As a result, a stream of gas moving from the puffer chamber 5 through the throat of the second insulating nozzle 10 and directed outwardly of the chamber 5 is formed and blown against the arc in addition to the aforementioned stream of gas, so that the arc is extinguished by the two streams of gas flowing in opposite directions.

Like the first embodiment, this embodiment also provided with two insulating nozzles each arranged in one of the two streams of gas. This enables the current interrupting performance of the interrupting unit to be improved. By affixing the two insulating nozzles 16 and 10 to a fixed member, e.g. the insulating cylinder 12 as shown, it is possible to arrange the fixed contact 1 relative to the throat of the first insulating nozzle 16 such that there is a predetermined distance between them at all times. Since the blowing of the gas against the arc is initiated when the movable contact 2 moves the predetermined distance, it is possible to place limitations on arcing time.

In the embodiment shown in FIG. 3 and FIG. 4, the disengagement of the movable contact 2 from the fixed contact 1 takes place outside the puffer chamber 5 or on the downstream side of the throat of the first insulating nozzle 16 with respect to the stream of gas flowing therethrough. Thus, even if the current interrupted has a high value, an electric arc produced between the two contacts exerts no influences on the arc extinguishing gas in the puffer chamber 5, and the arc extinguishing gas shows an ideal rise in pressure as the interrupting unit is operated by the operating device.

By utilizing the aforementioned feature, it is possible to cause the movable contact 2 and fixed contact 1 of the first embodiment shown in FIG. 1 and FIG. 2 to be released from engagement with each other outside the puffer chamber by causing a wiping action to be performed between the two contacts. One insulating nozzle 8 is movable and the other insulating nozzle 10 is fixed, so that the contact which is first withdrawn from the throat of the associated insulating nozzle will be spaced apart from the throat of the associated insulating nozzle a very large distance at the time the two contacts are withdrawn from the throats of the associated insulating nozzles. This will increase the power of the arc outside the puffer chamber 5 or on the lower pressure side.

In the second embodiment, high dielectric strength can be produced because the arc extinguishing gas separates the two insulating nozzles 10 and 16 from each other, although the two insulating nozzles are disposed close to each other.

Figure 5:
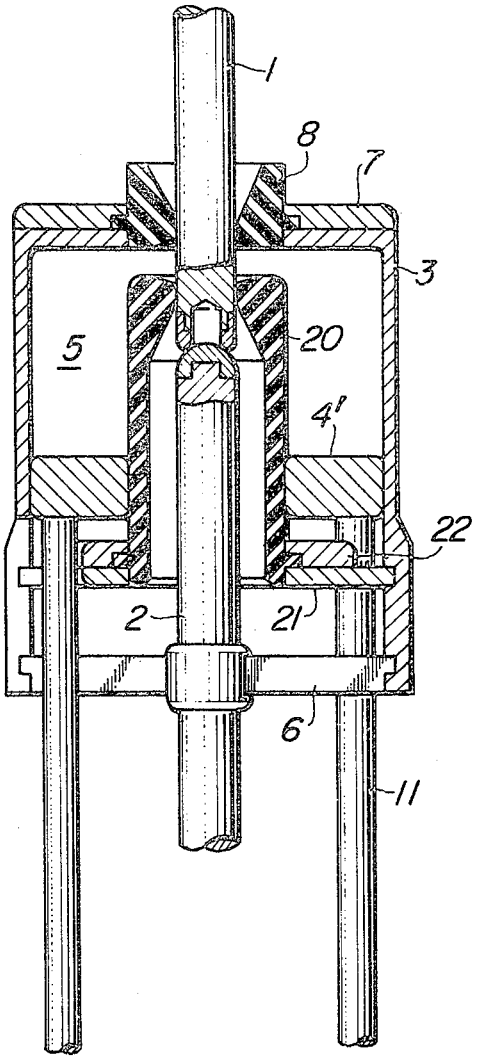
FIG. 5 is a vertical sectional view of the interrupting unit of the circuit breaker comprising a third embodiment of the invention, showing the interrupting unit in a circuit making position.

In the second embodiment, the two insulating nozzles 10 and 16 are affixed to a fixed member. The aforementioned effect can be achieved by fixing the first insulating nozzle 16 and the second insulating nozzle 10 relative to each other. FIG. 5 shows one embodiment of this construction.

In the third embodiment shown in FIG. 5, the first insulating nozzle 8 is fixed to the cylinder 3 as is the case with the first insulating nozzle of the first embodiment, and the second insulating nozzle 20 is held between a support plate 21 and a keep plate 22 fixed to the cylinder 3. The second insulating nozzle, 20, which is in sliding engagement with inner periphery of the piston 4', has its throat disposed in the puffer chamber 5.

The fixed contact 1 extends through the associated first insulating nozzle 8 and the throat of the second insulating nozzle 20 into engagement with the movable contact 2. That is, there is a predetermined distance which remains constant at all times between the movable contact 2 and the throat of the second insulating nozzle 20 associated therewith.

The embodiment in which the two insulating nozzles 8 and 20 are fixed to a movable member, e.g. the puffer cylinder 3, and supported thereby can achieve the same results as the embodiment shown in FIG. 3 and FIG. 4 by simplifying the construction. This is because of the fact that, when either one of the piston 4' and cylinder 3 defining the puffer chamber 5 is fixed member, the insulating nozzles are generally supported on the movable contact side.

Figure 6:
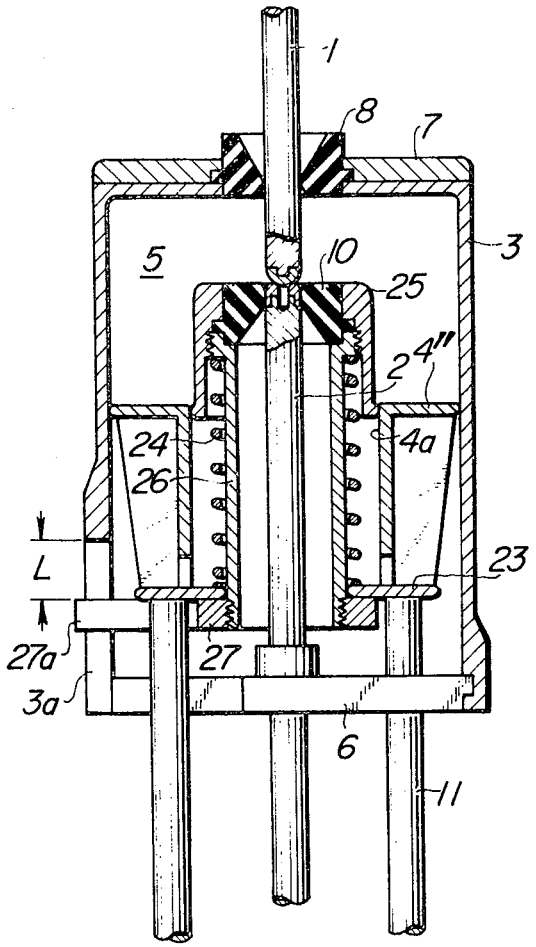
FIG. 6 and FIG. 7 are vertical sectional views of the interrupting unit of the circuit breaker comprising a fourth embodiment of the invention, with FIG. 6 showing the interrupting unit in a circuit making position and FIG. 7 showing the same in a circuit breaking position.
Figure 7:
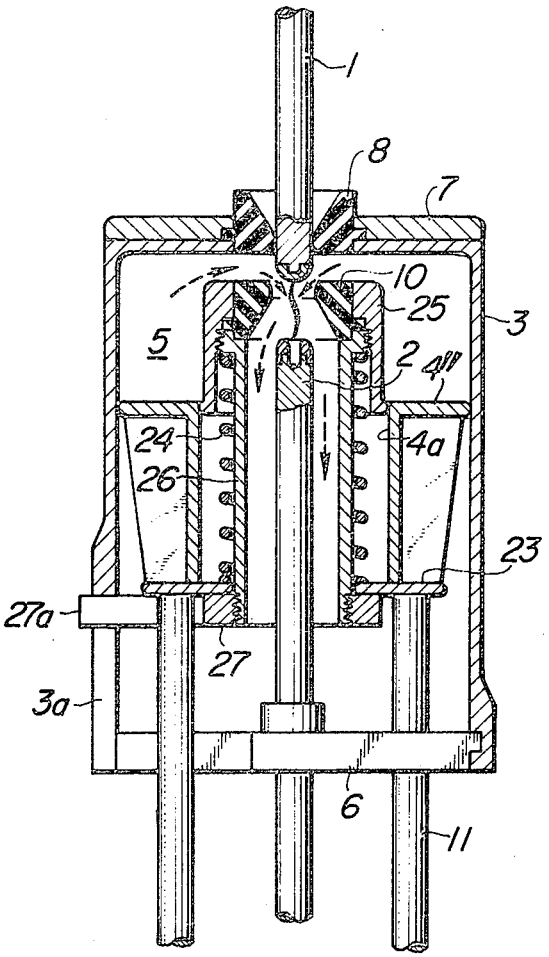

FIG. 6 and FIG. 7 show a fourth embodiment of the invention which enables arcing time to be further reduced.

To reduce arcing time, the interface between the contacts in engagement with each other has only to be located in the vicinity of the throat of one of the insulating nozzles. With this arrangement, however, an electric arc produced when the contacts are brought out of engagement with each other would have detrimental effect on the arc extinguishing gas in the pufffer chamber. This disadvantage is obviated in this embodiment by arranging the movable contact in the vicinity of the throat of the second insulating nozzle in initial stages of current interruption while keeping the second insulating nozzle fixed in position, and then maintaining the movable contact and the throat of the second insulating nozzle in relative positions in which they are spaced apart from each other a predetermined distance after they are brought to such relative positions.

The fourth embodiment of the invention is shown in a circuit making position in FIG. 6 in which parts similar to those shown in FIG. 1 and FIG. 2 are designated by like reference characters. The piston 4'' is formed therein with a spring seat 23 which supports one end of a compression spring 24 floatingly supporting the second insulating nozzle 10 at the other end.

More specifically, the second insulating nozzle 10 is held by two metallic keep members 25 and 26. The member 25 performs the functions of preventing the gas in the puffer chamber 5 from communicating with ambient gas when the second insulating nozzle 10 acts and of guiding the movement of the second insulating nozzle 10. The member 25 is mounted for sliding engagement with axial inner periphery of the piston 4''. The member 26 performs the functions of leading gas out of the puffer chamber 5 through the throat of the second insulating nozzle 10, and of transmitting a drive force to the second insulating nozzle 10.

Connected to the lower end of the keep member 26 is a lever 27 which is disposed at right angles to the movable contact 2. The lever 27 includes a projecting portion **27*a* which is disposed in slit 3*a* formed axially in the cylinder 3. If the cylinder 3 moves a predetermined distance L in a direction in which the current is interrupted, the lever 27 is connected to the cylinder 3 so as to break the curcuit. The upper limit of the movement of the lever 27 is set as it engages the lower end surface of the spring seat 23**.

When the circuit is made as shown in FIG. 6, the second insulating nozzle 10 is urged to move upwardly by the biasing force of the compression spring 24. With the lever 27 being in engagement with the spring seat 23, the throat of the second insulating nozzle 10 is located in the vicinity of the interface between the two contacts 1 and 2. The cylinder 3 is spaced apart from the lever 27 the predetermined distance L.

A circuit breaking operation will be described. The movable contact 2 is moved downwardly by means of an operating device (not shown). An electric arc is produced between the two contacts 1 and 2 as soon as they are brought out of engagement with each other. Since the second insulating nozzle 10 is held by the biasing force of spring 24 against the spring seat 23 which is a fixed member, the movable contact 2 is withdrawn from the throat of the second insulating nozzle 10. Thus, in initial stages of production of the arc, a stream of gas flowing from the puffer chamber 5 to ambient gas through the throat of the second insulating nozzle 10 is formed and blown against the arc to suppress the power of the arc. Then, upon the movable contact 2 covering the predetermined distance L as shown in FIG. 7, the lever 27 is connected to the cylinder 3 so as to break the circuit.

Thereafter, the operation performed is similar to that performed by the embodiment shown in FIG. 5. That is, the distance between the throat of the second insulating nozzle 10 and the movable contact 2 remains constant, so that it is possible to suppress the power of the arc by regulating the length of the arc on the lower pressure side. As the throat of the first insulating nozzle 8 is released from engagement with the fixed contact 1, a stream of gas leading from the puffer chamber 5 to the outside through the throat of the first insulating nozzle 8 is formed and blown against the arc. Thus two streams of gas are formed and blown against the arc.

In this embodiment, the movable contact 2 is located, in initial stages of circuit breaking, in the vicinity of the throat of the second insulating nozzle 10 which is then biased into position, and then the movable contact 2 is connected to the second insulating nozzle 10 to perform a current interrupting operation when the movable contact 2 is spaced apart from the throat of the second insulating nozzle 10 the predetermined distance L. Thus the arc extinguishing gas is blown against the arc as soon as it is produced, thereby enabling to reduce arcing time.

In all the embodiments shown and described hereinabove, the cylinder and piston which define a puffer chamber have been described as being arranged in a container filled with a charge of arc extinguishing gas of uniform pressure. It is to be understood, however, that the invention can have application in a puffer type gas circuit breaker in which the inner wall surface of the container itself can serve as a cylinder without requiring to provide a separate cylinder. It is also to be understood that, when it is desired to increase the flow rate of gas, one or both of the two contacts may be formed in hollow shape to utilize the space therein as a gas discharging space.

We claim:

1. In a puffer-type gas-blast circuit breaker comprising at least one interrupting unit mounted in a vessel filled with arc extinguishing gas at uniform pressure, said interrupting unit including:

a fixed contact, a movable contact oppositely aligned with said fixed contact, said movable contact being movable toward and away from said fixed contact to be engaged with and disengaged from said fixed contact respectively, wherein an arc is established between said fixed and movable contacts when being disengaged, a cylinder having a substantially closed end and an open end, a piston within said cylinder for defining a puffer chamber between said piston and said substantially closed end of said cylinder, said cylinder and said piston being relatively movable, means for connecting one of said cylinder and said piston to said movable contact outside said puffer chamber, a first insulating nozzle mounted through said substantially closed end of said cylinder coaxially with said contacts, and a second insulating nozzle mounted through said piston and aligned with said first insulating nozzle, said first and second insulating nozzles being separated from one another, each of said first and second insulating nozzles having therein a throat portion for communicating said puffer chamber with the exterior thereof, said throat portions capable of being blocked by at least one of said fixed and movable contacts, and the arc-extinguishing gas being compressed and exhausted from said puffer chamber through said throats toward said contacts upon disengaging movement of said movable contact from said fixed contact.

2. A circuit breaker according to claim 1, wherein one of said first and second insulating nozzles is connected to a fixed member of the interrupting unit and the other said insulating nozzle is connected to a movable member of the interrupting unit.

3. A circuit breaker according to claim 1, wherein said first and second insulating nozzles are both connected to a fixed member of the interrupting unit.

4. A circuit breaker according to claim 1, wherein said first and second insulating nozzles are both connected to a movable member of the interrupting unit.

5. A circuit breaker according to claim 3, wherein said fixed and movable contacts are arranged such that the disengagement of the movable contact from the fixed contact is initiated on the downstream side of the throat of one of said first and second insulating nozzles with respect to the stream of gas flowing therethrough and blown against the arc.

6. A cirucit breaker according to claim 4, wherein said fixed and movable contacts are arranged such that the disengagement of the movable contact from the fixed contact is initiated on the downstream side of the throat of one of said first and second insulating nozzles with respect to the stream of gas flowing therethrough and blown against the arc.

7. A circuit breaker according to claim 1, wherein said first insulating nozzle is connected to said closed end of said cylinder, and said second insulating nozzle is connected to said piston, and wherein said movable contact is connected by said means for connecting to said cylinder.

8. A circuit breaker according to claim 1, wherein said first insulating nozzle is connected to a fixed part of said interrupting unit to be slidable through said closed end of said cylinder, and said second insulating nozzle is connected to said piston, said piston being connected to said fixed part, and wherein said movable contact is connected by said means for connecting to said cylinder.

9. A circuit breaker according to claim 1, wherein said first insulating nozzle is connected to said closed end of said cylinder, and said second insulating nozzle is connected to a side wall of said cylinder to be slidable through said piston, and wherein said movable contact is connected by said means for connecting to said cylinder.

10. A circuit breaker according to claim 9, wherein said movable contact is maintained at a predetermined distance from the throat portion of said second insulating nozzle.

11. In a puffer-type gas-blast circuit breaker comprising at least one interrupting unit mounted in a vessel filled with arc extinguishing gas at uniform pressure, said interrupting unit including:

a fixed contact, a movable contact oppositely aligned with said fixed contact and movable toward and away from said fixed contact to be engaged with and disengaged from said fixed contact respectively, wherein an arc is established between said fixed and movable contacts when being disengaged.

a cylinder having a substantially closed end and an open end, a piston within said cylinder for defining a puffer chamber between said piston and said substantially closed end of said cylinder, said cylinder and said piston being relatively movable.

means for connecting said cylinder to said movable contact outside said puffer chamber, a first insulating nozzle mounted through said substantially closed end of said cylinder coaxially with said contacts, a second insulating nozzle aligned with said first insulating nozzle and floatingly supported on said piston by spring means, said first and second insulating nozzles being separated from one another, each of said first and second insulating nozzles having therein a throat portion for communicating said puffer chamber with the exterior thereof, said throat portions capable of being blocked by at least one of said fixed and movable contacts, and means for mechanically connecting said second insulating nozzle to said movable contact when said movable contact is spaced apart from said throat of said second insulating nozzle at a predetermined distance downstream of said second insulating nozzle with respect to the stream of gas flowing therethrough, the arc-extinguishing gas being compressed and exhausted from said puffer chamber through said throat portions toward said contacts upon disengaging movement of said movable contact from said fixed contact.

* * * * *